United States Patent [19]

Froitzheim

[11] 4,270,053

[45] May 26, 1981

[54] ELECTRONIC OR IONIC OPTICAL APPARATUS

[75] Inventor: Hermann Froitzheim, Aachen, Fed. Rep. of Germany

[73] Assignee: Leybold-Heraeus GmbH, Cologne, Fed. Rep. of Germany

[21] Appl. No.: 89,840

[22] Filed: Oct. 31, 1979

[30] Foreign Application Priority Data

Nov. 9, 1978 [DE] Fed. Rep. of Germany ..... 2848538

[51] Int. Cl.[3] ..... H01J 35/16

[52] U.S. Cl. ..... 250/508; 250/514

[58] Field of Search ..... 250/508, 457, 396 R, 250/509, 514

[56] References Cited

U.S. PATENT DOCUMENTS 3,117,224 1/1964 Francis et al. .

4,123,655 10/1978 Maixner et al. ..... 250/305

FOREIGN PATENT DOCUMENTS 2639033 3/1978 Fed. Rep. of Germany .

OTHER PUBLICATIONS

"The Use of-Solid State Detector-Spectrometer", by Elliott et al., Nuclear Inst. & Methods, vol. 59, 1968, pp. 29-39.

"Reduction of Spurious Background-", by Frontzheim et al., Rev. of Scientific Inst., vol. 46, No. 10, pp. 1325-1328, Oct. 1975.

*Primary Examiner*—Harold A. Dixon

*Attorney, Agent, or Firm*—Sprung, Felfe, Horn, Lynch & Kramer

[57] ABSTRACT

Electronic or ionic optical apparatus having baffled wall areas wherein the individual baffles are constructed and positioned such that a maximum probability is created for particles departing from the desired paths through the apparatus to pass through the baffles. A chamber is preferably provided behind the baffled wall areas which is closed off except for the openings between the individual baffles.

8 Claims, 2 Drawing Figures

ELECTRONIC OR IONIC OPTICAL APPARATUS

BACKGROUND

This invention relates to electronic or ionic optical apparatus, which is understood as meaning any apparatus through which electrically charged particles pass, such as electrons, protons, ionized atoms or molecules or the like, and in which fields affecting the movement of the electrically charged particles prevail. Examples of such apparatus are any energy-dispersive or mass-dispersive spectrometers and monochromators for charged particles, which are formed, for example, of spherical condensers, spherical mirrors, cylindrical condensers, cylindrical mirrors, plate condensers and the like. Also to be included are electrostatic or magnetostatic lens systems.

In all these systems the suppression of background is problematical. The background is due mainly to some of the charged particles which pass through the system, and which, on account of excessive angular divergence or excessive departure from the required energy, impinge upon the inner walls of the system where they rebound or produce secondary particles.

Many different measures have been taken to suppress the background created in this manner. One measure consists in using masks to limit the beam of particles before it enters the system. This, however, only reduces the angular divergence, but not the velocity distribution, so that a certain reduction of the background is achieved but it entails considerable intensity losses. The reason for this is that the divergence angle must be restricted much more severely than necessary in order to mask out particles whose divergence angle is small, but whose velocity departs excessively from the desired velocity.

It has been proposed in German Offenlegungsschrift No. 2,639,033 to make the wall portions seen by the electrically charged particles from materials having a low dusting rate and a low desorption rate, and to provide in these wall areas a plurality of small, closely adjacent apertures. It has also been proposed by Froitzheim et al. in *Rev. Sci. Instrum.*, Vol. 46, No. 10, pp. 1325–28, Oct. 1975, to provide analyzer plates with a sawtooth configuration. The use of anti-scatter baffles has been proposed by Elliott et al. in *Nuclear Instruments and Methods,* 59 (1968) pages 29–39. These proposals, however, result in a certain background suppression, but one which is disproportionate to the increased cost of the production of the wall portions.

SUMMARY

The present invention provides an electronic or ionic optical apparatus in which a virtually complete background suppression is accomplished in spite of its relative simplicity of construction.

This is achieved in accordance with the invention in that the electronic or ionic optical apparatus has baffled wall areas wherein the baffles are so constructed and positioned that a maximum probability is created for particles departing from the desired paths to pass through them. By these measures, virtually all of the particles departing from the desired paths will leave the system, so that they cannot provoke any undesirable secondary processes.

It is preferred that a chamber to be provided in back of the baffled wall areas which is closed off except for the openings between the baffles. The particles passing through the baffles are captured in this chamber as in a Faraday cup.

DESCRIPTION OF THE DRAWING

Additional advantages and details of the invention are described herein in conjunction with the drawing wherein.

DESCRIPTION

Figure 1:
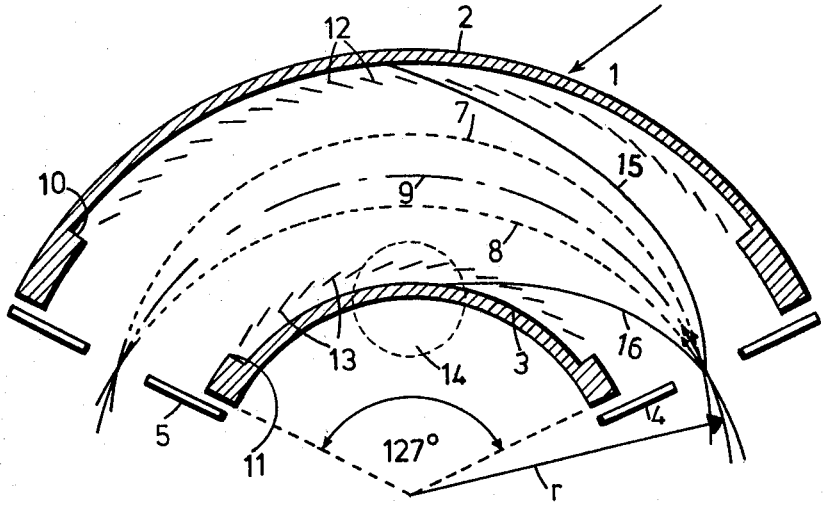
FIG. 1 is a cross-sectional diagrammatic view of a device of the invention.

The embodiment illustrated in FIG. 1 is a 127° cylindrical condenser 1 having the principal radius r, which consists of two cylindrically curved condenser plates 2 and 3. Between the plates there is a central electrical field which forces the charged particles entering through the aperture 4 into curved paths. Due to the interplay between centrifugal force and the force of the electrical field, only those charged particles can leave the condenser again through the aperture 5 whose velocity has a certain value at an equal e/m ratio. Three possible particle paths are indicated by broken lines and by the dash-dotted line.

Figure 2:
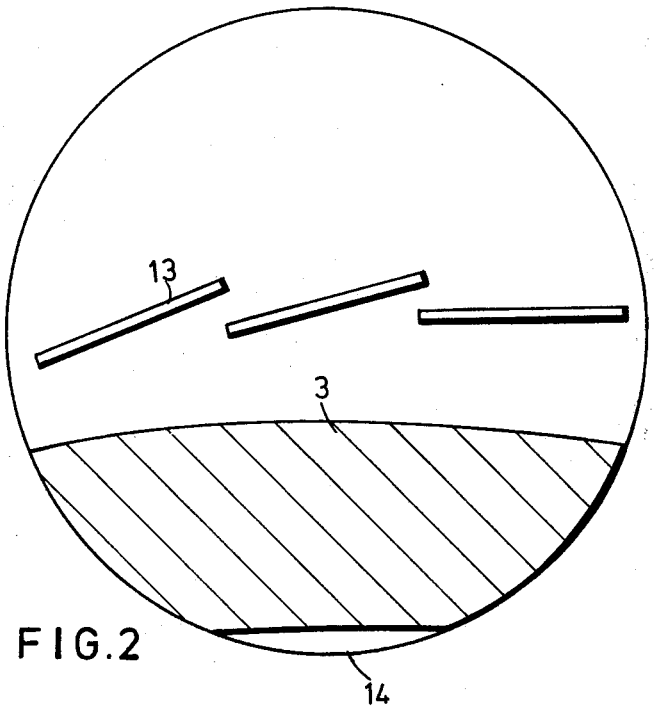
FIG. 2 is an enlarged view showing the positioning of the baffles in the device of FIG. 1.

In accordance with the invention, critical wall areas of the condenser plates are baffled. For this purpose the condenser plates 2 and 3 have recesses 10 and 11 which are masked by the baffles 12 and 13. The baffles must be arrayed so closely together that the central electrical field will undergo no deformation adjacent the desired paths. Preferably they overlap. This is especially evident in FIG. 2 in which a small portion 14 of the condenser plate 3 is represented with the baffles 13 in front of it. It is desirable that the width of the baffles be smaller than one-tenth of the principal radius r.

In FIG. 1, two particle paths 15 and 16 are indicated which deviate from the desired path area. Such particles impinge upon the walls of the illustrated cylindrical condenser. If the walls were continuous, secondary particles would be produced on them and cause an intensified background. Due to the baffling which is oriented generally parallel to a deviate particle path, however, the particles emerge from the electrical field acting on them and they are trapped in the recesses 10 and 11. Even if they were to cause secondary processes there, the probability with which the secondary particles would pass between the baffles back into the desired path area and emerge through the aperture 5 is virtually nil.

The shape and positioning of the baffles 13 is determined such that the probability that the particles departing from the desired paths will pass through the baffles will be as great as possible (at a maximum). Since the particles strike the condenser surfaces at grazing angles, the baffles should be very thin and arranged so as to offer little frontal area to the particles at their angle of incidence. An angle of about 15° between the condenser plate tangent and the baffle at that point has proven especially desirable. But even at angles of 5° to 25°, a high background suppression is brought about. Additional preferred dimensions for baffles in a cylinder condenser are:

$$\text{Baffle thickness: } = \frac{5}{100} \text{ mm}$$

Baffle width: less than 1/10 r

Overlap: $\frac{1}{3}$ to $\frac{1}{4}$.

With a cylindrical condenser corresponding to the illustrated embodiment, an improvement of the background signal ratio amounting to 4 powers of ten can be achieved over conventional cylindrical condensers. The making of the walls is relatively simple. In other electronic or ionic optical apparatus in which baffles acting in a similar manner must be provided with curvature, the manufacturing cost is still reasonable due to the surprisingly high background suppression.

What is claimed is:

1. Electronic or ionic optical apparatus comprising means forming a particle path with baffle means including baffles inclined about 5° to 25° with respect thereto and disposed such that there is a high probability of passage therethrough of particles deviating from the desired particle path.

2. Apparatus of claim 1 wherein the means forming the particle path comprises a chamber behind the baffle means, said chamber being closed except for the baffle openings.

3. Apparatus of claim 2 wherein the baffles are several millimeters wide and their thickness does not exceed 0.05 mm.

4. Apparatus of claim 3, wherein the baffle means are narrower than 1/10 of the principal radius r.

5. Apparatus of claim 1 wherein the means forming the particle path is recessed in the critical areas which is covered by the baffle means.

6. Apparatus of claim 1 wherein the baffles of the baffle means overlap one another.

7. Apparatus of claim 1, wherein the inclination of the baffles is about 15°.

8. Apparatus of claim 1, wherein the means forming the particle path comprises cylindrical plates having a principal radius r.

* * * * *